United States Patent [19]

Baitis et al.

[11] 4,388,889

[45] Jun. 21, 1983

[54] ELECTRICAL ACTUATOR FOR SHIP ROLL STABILIZATION

[75] Inventors: A. Erich Baitis, Stafford, Va.; Dennis A. Woolaver, Rockville, Md.; Richard T. Nigon, Fairfax, Va.

[73] Assignee: The United States of America as represented by the Secretary of the Navy, Washington, D.C.

[21] Appl. No.: 248,389

[22] Filed: Mar. 31, 1981

[51] Int. Cl.[3] ..... B63H 25/00

[52] U.S. Cl. ..... 114/144 E; 114/122

[58] Field of Search ..... 114/144 R, 144 E, 122, 114/126; 318/585, 588

[56] References Cited

U.S. PATENT DOCUMENTS

| | | | |
|---|---|---|---|
| 2,923,874 | 2/1960 | Bell | 318/585 |
| 3,727,572 | 4/1973 | Nelson et al. | 114/126 |
| 3,738,304 | 6/1973 | Duberley | 318/585 |

*Primary Examiner*—Trygve M. Blix
*Assistant Examiner*—Jésus D. Sotelo
*Attorney, Agent, or Firm*—R. F. Beers; L. A. Marsh

[57] ABSTRACT

A ship stabilization system, which utilizes the rudders to compensate for wind and wave induced roll motions, includes a hydraulically actuated mechanism for controlling the position of the rudders; a pump coupled to the hydraulic mechanism for controlling the flow of hydraulic fluid; and a flow control device connected to the pump for controlling the flow rate of fluid through the pump. The ship stabilization system also includes a first actuation device for translating helm steering command signals into control impulses for the flow control device and a second actuation device for translating helm steering command signals and roll reduction control signals into control impulses for the flow control device. A coupler is connected to the first and second actuation devices and the flow control device for disengaging the first actuation device from the flow control means when the second actuation device is activated. The roll reduction signal processed by the second actuation device consists of the instantaneous roll rate of the ship and the statistical rate gain factor (K) that represents the reciprocal of the time-average roll rate, modified by the maximum allowable rudder rate and the natural roll period of the vessel. The rate gain circuit for producing the rate gain factor includes an absolute value circuit, a smoothing filter, a minimum value circuit, a divider circuit, and a second smoothing filter.

6 Claims, 5 Drawing Figures

ELECTRICAL ACTUATOR FOR SHIP ROLL STABILIZATION

BACKGROUND OF THE INVENTION

This invention generally relates to motion stabilization systems and more particularly to roll reduction devices used aboard marine vessels.

As a result of the increased importance of helicopters and vertical takeoff-landing aircraft as an integral part of naval combat systems, a major thrust of recent research and development effort in surface ship dynamics has been directed toward improving ship/aircraft interfacing. Since the ship/aircraft interface and various other ship mission areas are strongly dependent on weather, ship motions, and wave impact forces, it is desirable to reduce ship roll motions to minimize the possibility of damage to aircraft during landing and takeoff operations. It is also desirable to reduce ship roll motions to achieve satisfactory performance of all mission critical maintenance tasks. Accordingly, a particular area of ship stabilization research has involved attempts to utilize the installed rudder systems of ships to control and reduce the rate and magnitude of ship roll motions. However, problems have been experienced in developing compatible roll reduction systems because of operational interference between use of the rudder in reducing roll motions and utilization of the rudder as a steering mechanism.

SUMMARY OF THE INVENTION

The anti-roll device of the present invention overcomes drawbacks with the prior art by providing a roll reduction system which essentially comprises a hydraulic control means connected to the rudder; a pump means coupled to the hydraulic control means; flow control means connected to the pump means for controlling the flow rate of fluid through the pump means; and a first actuation means connected to the flow control means for translating helm signals into impulses for the flow control means. The roll stabilization device also includes a second actuation means for translating a combined helm and anti-roll signal into impulses for the flow control means. When the second actuation means is coupled to the flow control means and activated, the first actuation means is decoupled from the flow control means. This is accomplished with a mechanical clutch-/decoupler which is operatively connected to the first and second actuation means.

The second actuation means includes an electronic actuation control which combines the helm signals with a resultant signal from a roll rate sensor and a rate gain circuit to provide a rudder command signal of a predetermined average magnitude. The rate gain circuit, which is connected to the roll rate sensor, produces a rate gain factor (K) that represents the reciprocal of the time-average of the roll rate (a'), modified by the maximum allowable rudder rate and the natural roll period of the vessel. After filtering the roll rate signal (a') to remove electrical noise, the roll rate signal (a') is rectified in an absolute value circuit to adjust the signal for further processing. The resultant absolute value roll rate signal (a') is then sent to a smoothing filter which tends to average or smooth the excursions of the rectified signals from the absolute value circuit. A minimum value circuit is utilized so that the resultant signal from the smoothing filter will have at least a minimum value. The signal from the absolute value circuit is then processed in a divider circuit that produces the reciprocal of the initial signal. The resultant rate gain signal (K) represents the reciprocal of the statistical time average of the roll rate modified by the maximum allowable rudder rate and the natural roll period of the vessel. The rate gain signal (K) is further processed in a smoothing filter to reduce the excursions of the signal from the predetermined value. The resultant rate gain signal (K) and the roll rate signal (a') are combined in a multiplier device to produce a ship roll stabilization signal (Ka').

The roll stabilization signal and the helm control signal are combined to produce a resultant rudder command signal. The rudder command signal is compared with a signal representative of the instantaneous position of the rudder, and the resultant difference signal is fed to a mechanical actuator that translates the electrical signal into a mechanical impulse for the flow control means. The magnitude of signal fed to the flow control means determines the flow rate of fluid in the hydraulic control means and, thus, the position of the rudder.

Accordingly, an object of the present invention is to stabilize marine vessels against wave and wind induced roll motions.

Another object of this invention is to provide a roll stabilization system for marine vessels which is coupled with the rudder of the ship without affecting the steering of the vessel.

Yet another object of the present invention is the provision of an efficient roll stabilization system which can be installed with existing steering machinery.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may be best understood by reference to the following description taken in connection with the accompanying drawings, in which:

DETAILED DESCRIPTION OF THE INVENTION

Figure 1:
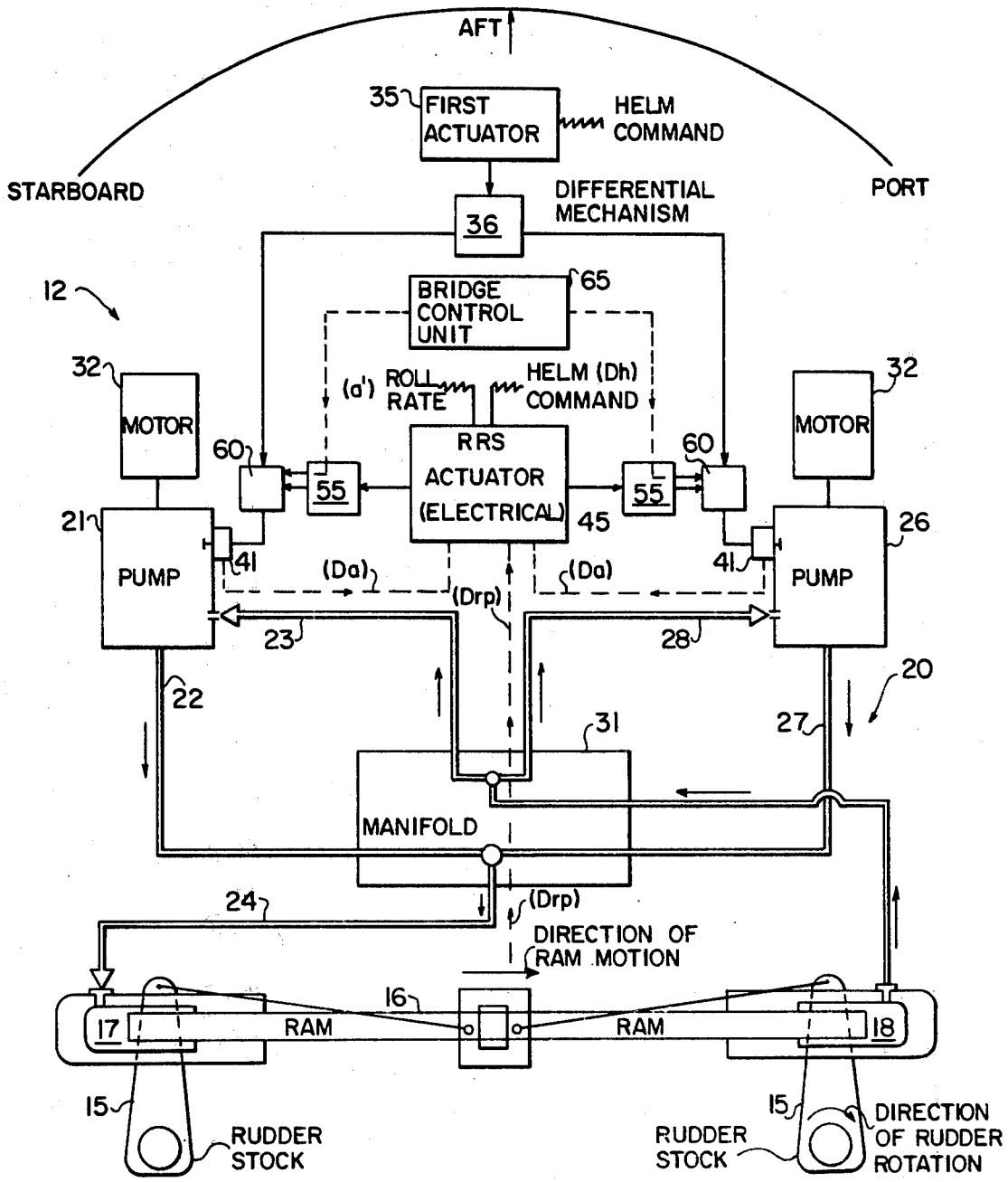
FIG. 1 is a simplified diagrammatic view of the roll reduction system of the present invention.
Figure 2:
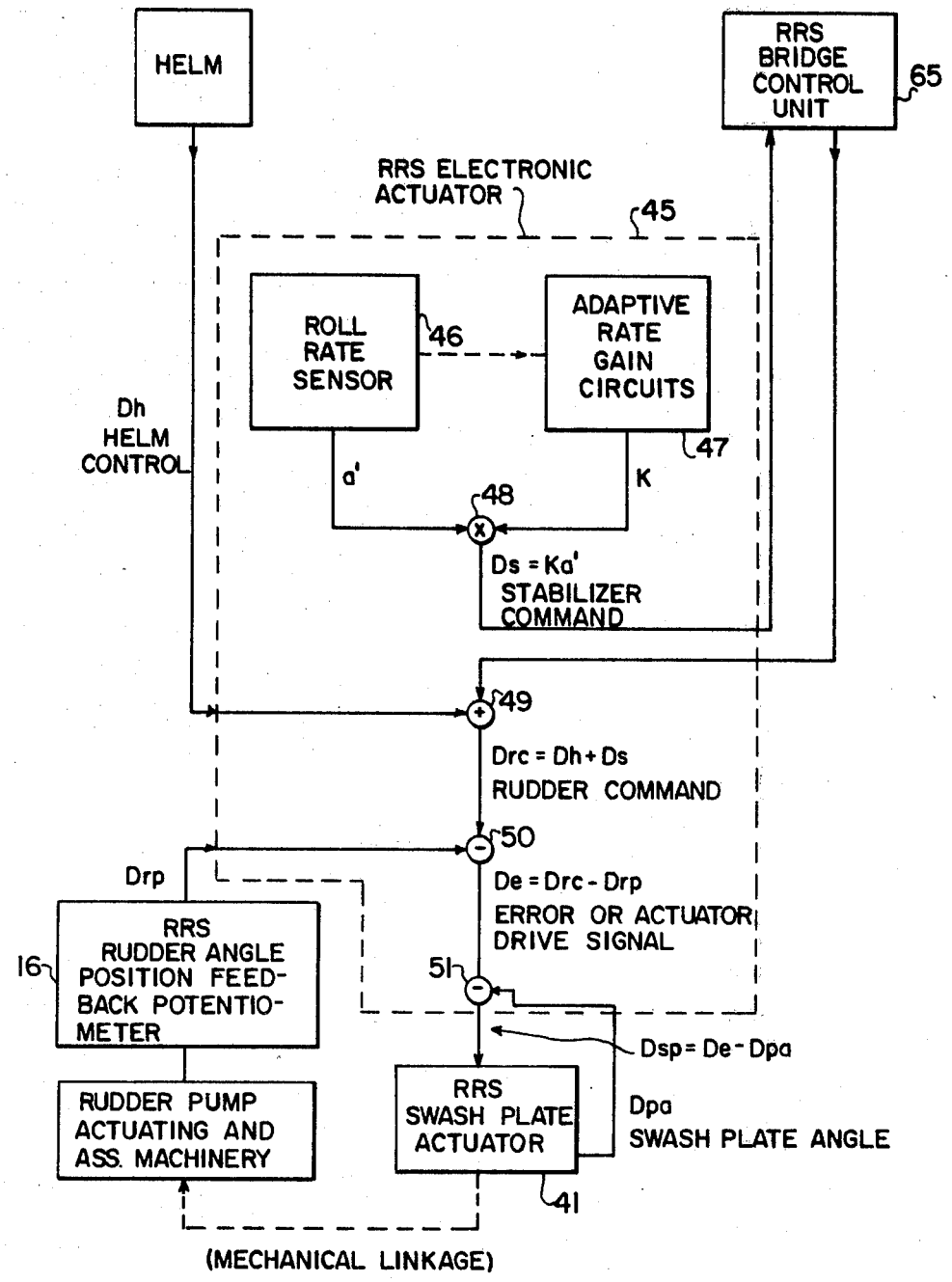
FIG. 2 is a simplified block diagram of the electronic control system of the present invention.

Referring now to the drawings and to FIG. 1 in particular, there is shown a simplified diagram of the roll reduction rudder control system 12 of the present invention. The roll reduction system 12 includes a hydraulically actuated control means in the form of a hydraulic fluid circuit 20 which is coupled to a hydraulic ram mechanism 16 that drives a tandem arrangement of rudders 15. A pump means comprising hydraulic pumps 21,26 and pumps motors 32 is interconnected with the hydraulic circuit 20 to produce a preselected fluid flow in the hydraulic circuit 20 that causes ram mechanism 16 to move rudders 15 to a predetermined position. The roll reduction system 12 also includes a hydro-mechanical flow control means in the form of flow controls 41 that are coupled to pumps 21,26 for controlling the flow rate of hydraulic fluid through pumps 21,26; a first actuation means which is connected to flow controls 41 for translating helm signals into impulses for the flow controls 41; and a second actuation means for translating a combined helm and anti-roll signal into impulses for flow controls 41. The second actuation means is coupled to the flow controls 41 so that the first actuation means is decoupled from pumps 21,26 when the second actuation means, as more particularly illustrated in FIG. 2, is activated.

The ram mechanism 16 is pivotally connected to the arrangement of tandem rudders 15 so that a shift of the ram mechanism 16 in one direction causes a corresponding rotation of the rudders 15 in the same direction. More particularly, the end portions of the elongated ram mechanism 16 are contained within hydraulic chamber 17,18 so that a flow of pressurized fluid into chamber 17 causes a corresponding shift of the ram end portion out of the chamber 17. The hydraulic fluid circuit 20 includes two fluid conduits extending from each pump, wherein a flow line from one pump is connected to one of the hydraulic chambers 17 and the other flow line from such pump is connected to the other hydraulic chamber 18. Thus, in FIG. 1 ducts 22 and 23 from pump 21 are connected to respective chambers 17 and 18, and ducts 27 and 28 from pump 26 are connected to respective chambers 17 and 18. To provide a uniform response to impulses from the dual pumps, flow lines 22,27 are merged together into a single conduit 24 at manifold section 31, and flow lines 23,28 are merged together to form a single conduit 29 at manifold section 31.

Pumps 21 and 26 operate in response to the signals from flow controls 41 to cause the hydraulic fluid to flow through the pumps in a predetermined direction to the appropriate ducts and conduits at a predetermined pressure and flow rate. As shown for example in FIG. 1, the signal from flow controls 41, which is referred to as the swash plate flow controls, has actuated pumps 21,26 to produce a flow of fluid out of right chamber 18 and into left chamber 17 as indicated by the arrows to cause a clockwise rotation of rudders 15. If the signals to the swash plate flow controls 41 change so that is desired to rotate rudders 15 in a counterclockwise direction, a mechanical impulse is fed to pumps 21,26 to produce a flow of fluid into right chamber 18 and out of the left chamber 17. As rudders 15 approach the predetermined position, the flow of fluid through pumps 21,26 is continuously reduced until the flow rate reaches zero at the desired rudder position. An essential feature of the present invention is that pumps 21,26, hydraulic circuit 20, and ram mechanism 16 are arranged to permit a rapid movement of the rudders 15 in response to appropriate signals from the second actuation means. This may be accomplished, for example, by utilizing a ram mechanism 16 of the type manufactured by Jered Industries, a division of Brown Brothers-Jered Inc., Birmingham, Michigan (eg. Ram, Follow Up Link and Tiller Assembly; part M-20004-B). A compatible pump 21 or 26 having an integral swash plate flow control 41 is manufactured by New York Air Brake (eg. part #890172, model 45L0172 or Dyna Power Models 30,45,60,120,210). A suitable electric pump motor 32 is manufactured by Reliance Electric Co. (Mil Spec. Mil-M-17060, Navy Service A Frame #286 UN).

The first actuation means includes an electromechanical actuation device 35, such as manufactured by Sperry Marine Division of Sperry Rand (Rotary Hydraulic Power Unit #1880060 or 1883174), that translates electrical helm signals into appropriate signals for a differential mechanism 36. The differential mechanisms 36, such as manufactured Jered Industries (Control Unit #20004-D), are connected to left and right swash plate flow controls 41 and translate the impulses from the first actuator 35 into a mechanical movement of the swash plate flow control 41 to a predetermined position. The relative position of the swash plate flow controls 41 with respect to a neutral position causes pumps 21,26 to operate and produce a specific flow rate in the hydraulic lines.

The second actuation means, as depicted in FIGS. 1 and 2, includes an electrical roll reduction system actuator 45, herein referred to as a second actuator, that translates electrical signals from a roll rate sensor 46 and the helm into appropriate signals for a mechanical actuator 55 that is linked thereto. The particular electrical circuit details of the second actuator 45 are set forth in a copending application entitled "Ship Roll Stabilization System" by A. Erich Baitis and Dennis A. Woolaver, Ser. No. 247,484, filed Mar. 25, 1981, the teachings thereof are herein incorporated by reference. The mechanical actuators 55 for the second actuation means are coupled to mechanical clutch/decouplers 60, and the mechanical actuators 55 translate signals from second actuator 45 into mechanical impulses from the swash plate flow controls 41. A more specific operation of the mechanical actuators 55 is set forth in a copending application entitled "Mechanical Actuation Device for Ship Roll Stabilization" by Dennis A. Woolaver and A. Erich Baitis, Ser. No. 247,485, filed Mar 25, 1981, the teachings thereof are herein incorporated by reference. Mechanical clutch/decoupler devices 60 interconnect the first and second actuators 34,45 and the swash plate flow controls 41 so that the clutch device 60 disengages the first actuator 35 and differential mechanism 36 from the swash plate flow controls 41 when the second actuation means is activated. The operative details of the mechanical clutch/decoupler device 60 are set forth in a copending application entitled "Mechanical Clutch-/Decoupler for Hydraulic Pumps" by Dennis A. Woolaver and A. Erich Baitis, Ser. No. 247,486, filed Mar. 25, 1981, the disclosure of which is herein incorporated by reference. The roll reduction system of the present invention utilizes the rudder 15 to produce a roll moment in the ship which offsets the roll moment induced by the sea. That is, when the ship tends to roll to port due to an instantaneous sea state, the second actuation means produces a clockwise rotation of the rudders 15, to produce a roll moment that tends to roll/displace the bottom of the ship to starboard. A resultant stabilized rolling motion is produced when the oppositely directed wave induced ship roll and rudder induced roll moment are superimposed. The direction, displacement and phasing of the rudder movements determines how effectively the stabilizing moments are utilized.

The roll reduction system is designed to produce a rudder command signal that causes a maximum possible roll reduction for a range of frequencies. The roll reduction system utilizes a control law expressed as $$Ds = Ka'$$

where,

Ds = rudder stabilizer command signal, a' = roll rate,

K = variable roll rate gain factor.

The roll rate (a') is determined by a roll rate sensor 46 and the variable roll rate gain factor (K) is determined by adaptive rate gain circuitry 47. The gain factor (K) may be expressed as representing the reciprocal of the time-average of the roll rate, modified by the maximum allowable rudder rate and the natural roll period of the vessel. Thus, as the roll rate of the ship increases, the gain factor will normally decrease so that the product (Ka') remains about the same.

Under mild sea state conditions the roll reduction system 12 is normally activated so that the first actuation means comprising first actuator 35 and differential mechanism 36 is directly coupled with the flow controls 41. The helm command signal (Dh) is fed to first actuator 35 for translation into an appropriate response for differential mechanism 36. The differential mechanism 36 is mechanically coupled to the flow controls 41 so that the helm command signal (Dh) is translated into a control signal for pumps 21,26 to produce a directional flow rate of hydraulic fluid in hydraulic circuit 20. This produces a shift in hydraulic mechanism 16 and rudders 15 to a position which is proportional to the directional magnitude of the helm signal (Dh).

Figure 3A:
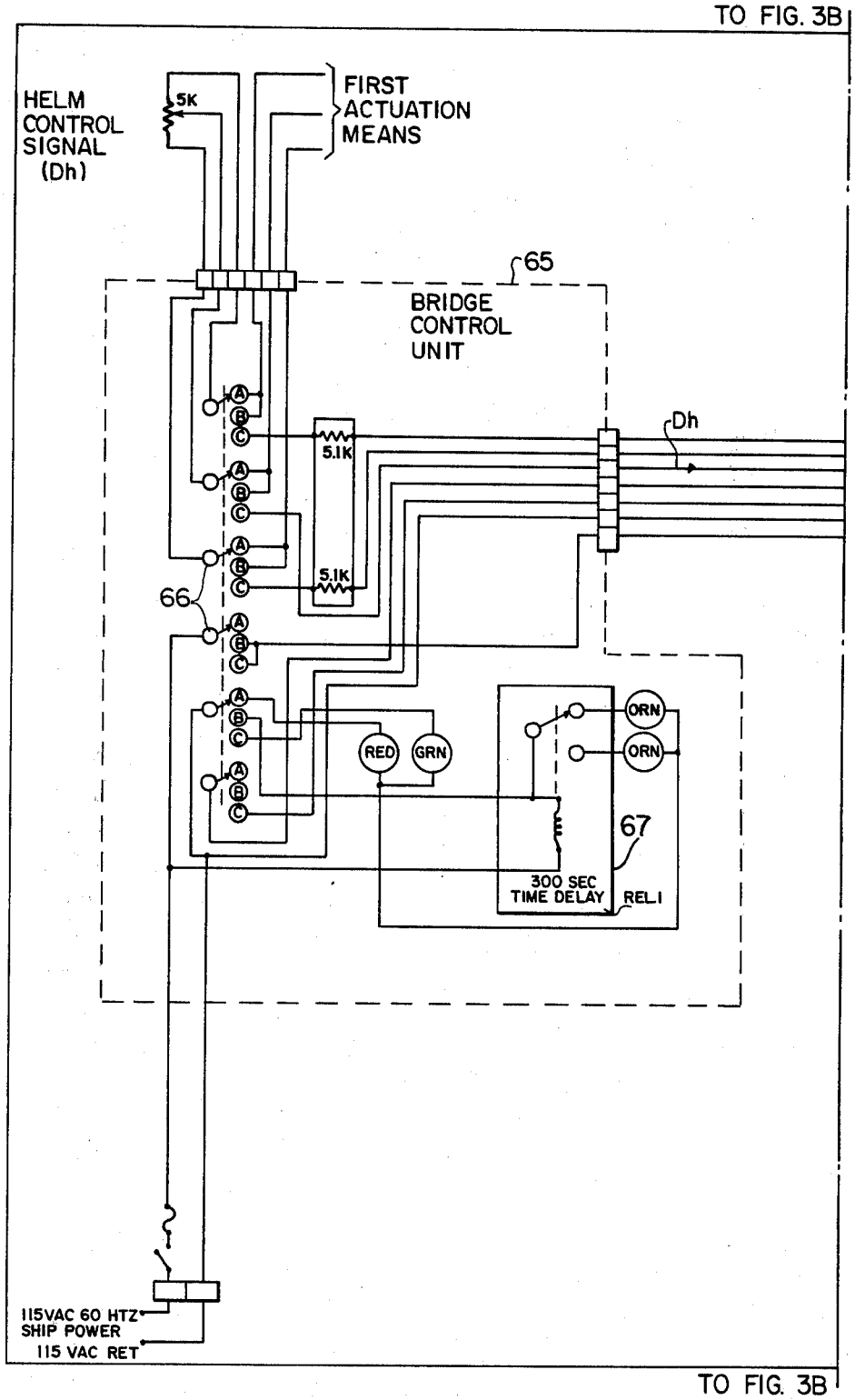
FIG. 3A is a partial view of the electrical schematic of the present invention.

The ship roll stabilization system can be activated in adverse sea state conditions or where ship stability is required for aircraft takeoff/landing operations. The roll stabilization system is initially activated when bridge control unit 65 as further shown in FIG. 3A is switched to the standby mode. While the first actuation means is still directly linked with pumps 21,26 and rudders 15 in the bridge control "standby" mode, the adaptive rate gain circuit 47 of second actuator 45 is determining a statistical roll rate gain factor K for an elapsed period of time. After a predetermined period of time (on the order of several minutes) the average roll rate gain K has been determined for such period of time and the roll stabilization system is activated by switching bridge control unit 65 from "standby" to "on". Thus in FIG. 3A, to change the bridge control unit 65 from the first actuation means control function to the standby mode, switch elements 66 are moved from contact A to engage contact B. Similarly, to change from the standby mode to the operational mode for the second actuation means, switch elements 66 are moved from contact B to contact C. In this particular case, a 300 second time delay device 67, with dual indicator lights marked "ORN" connected thereto, is used to indicate the beginning and end of the standby period.

When bridge control unit 65 is switched "on" so that the second actuation means is activated, another relay device 68 is switched on to activate a servo valve 70 (such as manufactured by the Parker-Hannifin Corporation, Cleveland, Ohio, model #3MD20AG). The servo valve 70, which constitutes part of mechanical actuator 55, is mechanically connected with mechanical decoupler 60 to activate the decoupler so that the first actuation means is disengaged from the flow controls 41 and the second actuation means (eg. second actuator 45, mechanical actuator 55) is operatively interlinked with the flow controls 41.

Upon switching the roll stabilization system to the "on" position, the second actuation means 45 produces a roll rate gain factor (K) that is combined (ie. mutiplied) with the roll rate (a') in a multiplier circuit 48 of the type manufactured by Analog Devices of Norwood, Massachusetts (Model No. AD533KD). The roll rate gain factor (K) represents a statistical factor which is determined according to the ship roll occurring over a previous predetermined period of time so that, on the average, the rudder stabilizer command (Ka') will not exceed the allowable rudder excursion more than a predetermined number of occurrences during a predetermined period of time. Thus, the roll rate gain factor (K) for high or heavy sea state conditions will be smaller than the roll rate gain factor (K) for mild sea state conditions, wherein the roll rate gain factor (K) in high sea states will approach but not generally exceed the allowable rudder movement. The rate of ship roll motion (a') is determined by a roll rate sensor 46 of the type manufactured by Humphrey Inc., San Diego, California (Model No. RT-03-0505-1). The roll rate sensor 46 is shown in FIG. 2 and in the detailed schematic of FIG. 3C.

In the simplified schematic of FIG. 2 the rudder stabilizer command signal (Ds), wherein (Ds = Ka'), is combined with the helm control signal (Dh) in a summing amplifier 49 of the type manufactured by Texas Instruments, Fairchild Industries of RCA (type micro A741) to produce a resultant rudder command signal (Drc), where (Drc = Dh + Ds). The superposition of the helm control signal (Dh) and the rudder stabilizer command signal (Ds) is possible, without mutual interference therebetween, in view of the fact that the initial change in course of a ship due to a change in rudder position takes on the order of about one minute while the roll response period of the ship to a rudder movement producing a roll moment is much shorter (eg. on the order of a few seconds). For example, since the waves are assumed to impose a harmonic type of roll motion on the ship (ie. the ship tends to roll to the left and right with equal moments) the net or resultant rudder deflection to reduce ship roll motion over a period of one minute for example, will statistically approach zero. Thus, the roll stabilization provided by rapid intermittent rudder movements (ie. on the order of a few seconds) is largely independent of the steering controlled rudder movements, which occur less frequently (ie. perhaps one or two per minute).

In FIG. 2, the superimposed rudder command signal (Drc), where (Drc = Dh + Ds), is sent from summing amplifier 49 to a difference amplifier 50 of the type manufactured by Analog Devices, Norwood, Mass. (Model No. 434B). However, a voltage limiting circuit (not shown in the FIG. 2 schematic) is provided between amplifier units 49 and 50 to limit the ranges of positive-negative voltage signals from summing amplifier 49 so that the rudder command signal (Drc) is compatible (voltage-wise) with the rudder position feedback signal (Drp). For example, if it is assumed that the rudder has a freedom of movement of ±30° and a feedback voltage of 1 volt has been assigned to each 6° of rudder movement the rudder feedback signal (Drp) will have a limit of ±6 volts. Accordingly, the rudder command signal (Drc) of the FIG. 2 schematic is also limited to a ±6 volts so the resultant difference or error command signal from difference amplifier 50 represents a proper command signal for the rudder.

In FIG. 2, the resultant error signal (De), where (De = Drc − Drp), from difference amplifier 50 is sent to a second difference amplifier 50 of the same type manufacture as difference amplifier 50. A second voltage limiting circuit (not shown in FIG. 2) is provided between amplifier units 50 and 51 to limit the voltage signals from the difference amplifier 50 so that the error signal (De) is compatible (voltage-wise) with the swash plate angle feedback signal (Dpa). The swash plate flow controls 41 for pumps 21,26 are normally arranged so that the swash plate flow control moves with equal magnitude in the positive and negative direction from a neutral position, wherein such movement produces a proportional flow response in the pumps 21,26. Thus, if it is assumed that a maximum voltage of ±0.2 volts is assigned to a corresponding maximum deflection (±) of the swash plate flow control 41, the error signal (De) will also be limited by the second limiting circuit to a ±0.2 volt maximum. The signals (De) and (Dpa) are combined in the second difference amplifier 51 and the resultant signal (Dsp) causes the swash plate flow control 41 to move to a predetermined position.

The second limiting circuit thereby allows the rudder mechanism to move in an "asymptotic" mode whereby rapid initial rudder movements of the rudders 15 are produced in response to a changing rudder command (Drc) and a declining rate of rudder movement occurs as the rudders approach the desired position. The second limiting circuit achieves this purpose by truncating error signals (De) from difference amplifier 50 that are larger than ±0.2 volts and forwarding a signal of ±0.2 volts. The swash plate flow controls 41 move in response to the modified error signal (De) so that the swash plate feedback signal (Dpa) matches the modified error signal (De) and the resultant swash plate command signal (Dsp) approaches zero. As the error signal (De) from difference amplifier 51 decreases below ±0.2 volts the second limiting circuit no longer truncates the voltage signal and the swash plate flow control 41 begins to move from its former maximum deflection position (eg. where Dpa=±0.2 volts). As the error signal (De) continues to decrease, the swash plate position signal (Dpa) also decreases until both are zero. At this point the rudders 15 will have reached their predetermined position and swash plate flow control 41 will be at the neutral position so that the flow of fluid through pumps 21,26 will have terminated. Thus, the elecrtical actuator 45 allows rapid rudder movements for error signals (De) above ±0.2 volts and an "asympotically" decreasing rate of rudder movements for error signals (De) below ±0.2 volts. This is important since the requisite change in rudder position to reduce ship roll may occur during a period of several seconds.

Figure 3B:
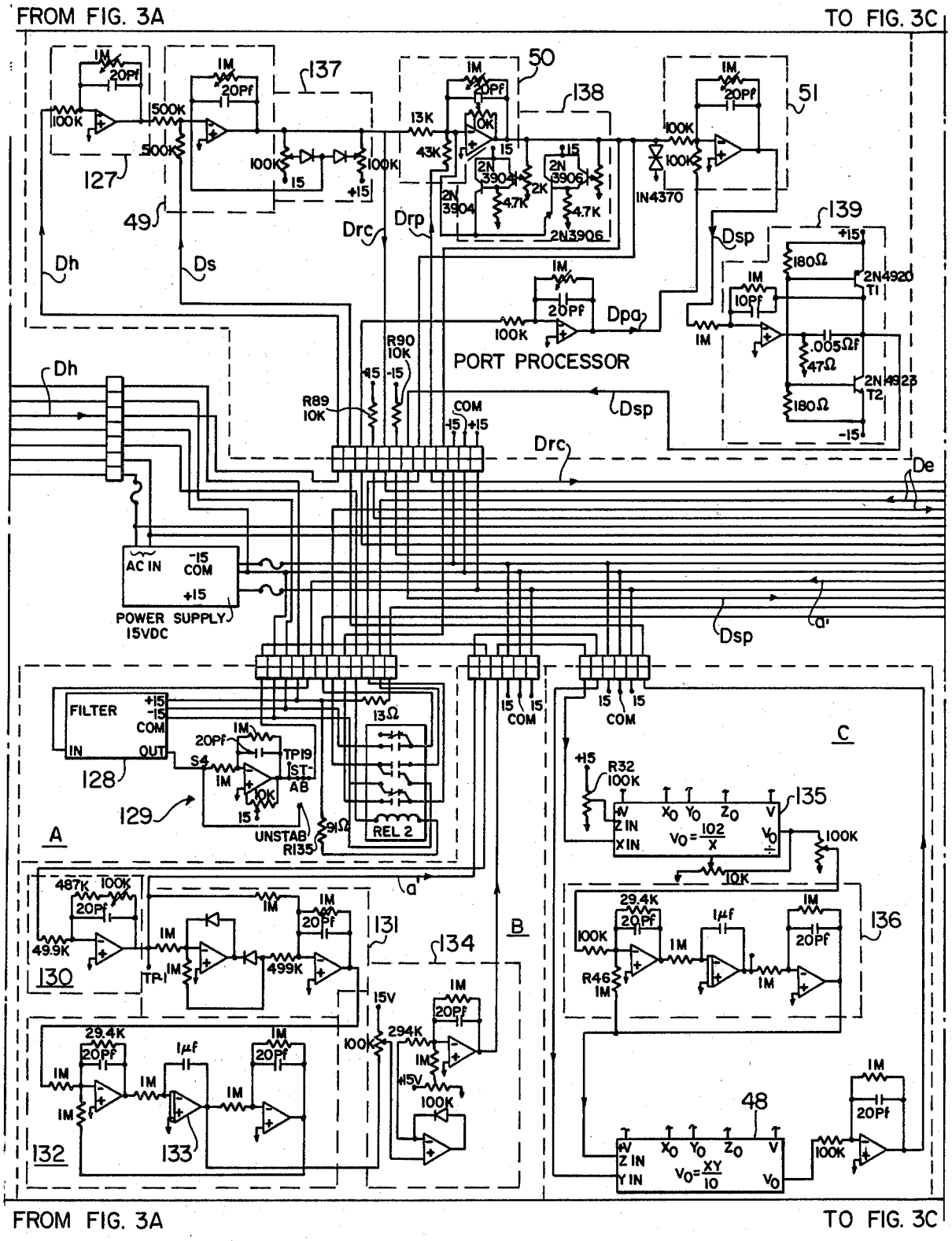
FIG. 3B is another partial view of the electrical schematic of the invention.
Figure 3C:
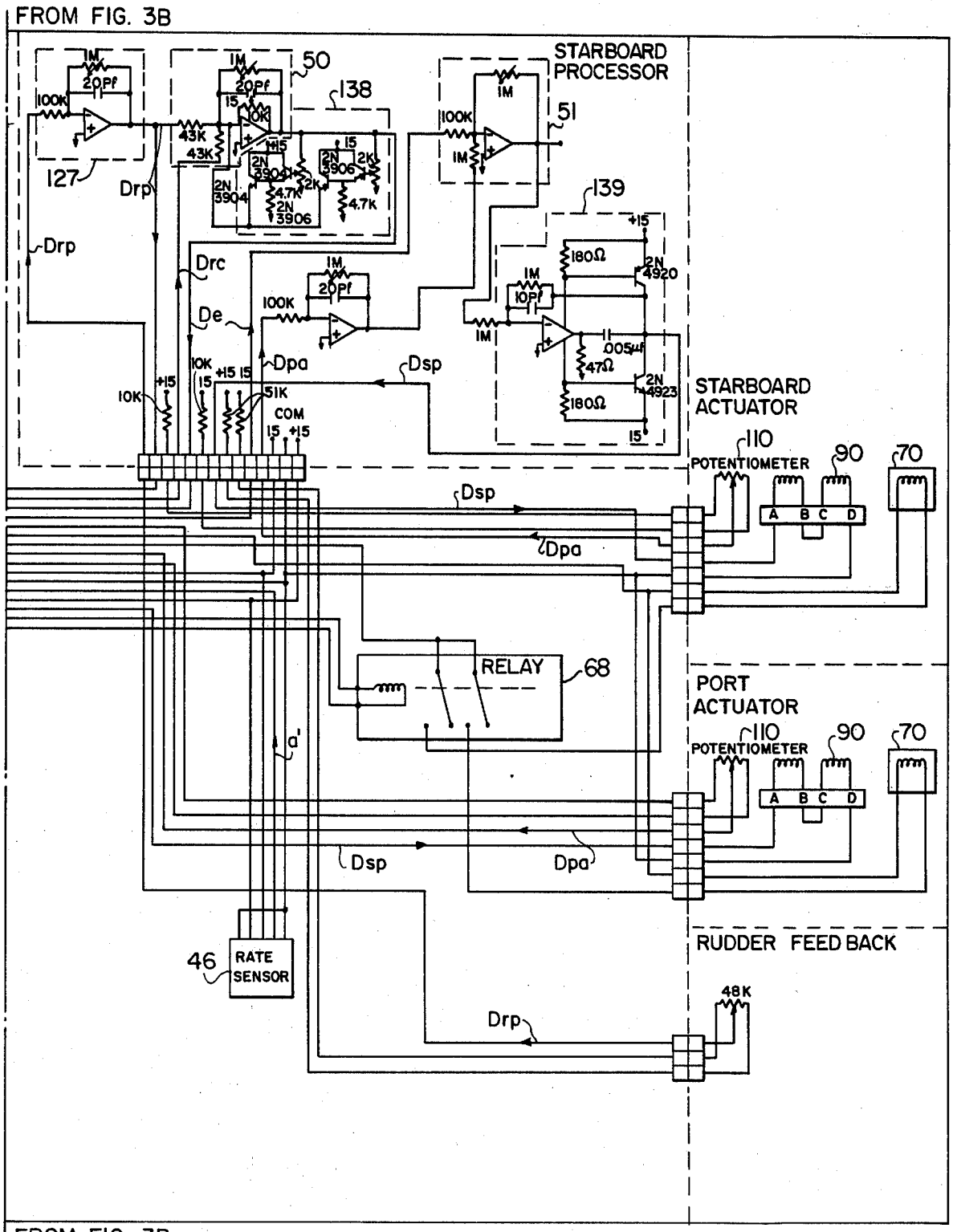
FIG. 3C is a further partial view of the electrical schematic of the invention.

Referring now to FIGS. 3A–3C there is shown a detailed schematic of the second actuator 45, also referred to as the roll reduction system (RRS) actuator. FIG. 3A depicts the helm control for generating the helm control signal (Dh); a bridge control unit 65 for switching the ship operation between the first actuation means and the second actuation means; and a power supply for operating the bridge control unit 65. As mentioned above, the bridge control unit 65 is provided with a switch element 66 to switch the operational mode of rudder control from the first actuation means (contact B), and the second actuation means (Contact C). With the switch element 66 engaging contact A, the helm control signal (Dh) passes through the bridge control unit 65 to the first actuation means. In the "standby" mode, the switch element 66 is moved to engage contact B and, while the helm control signal (Dh) still passes to the first actuation means the variable rate gain circuit 47 is determining an appropriate rate gain factor (K). The second actuation means is activated when the switch element 66 is moved to engage contact C. This activates servo-valves 70 for the port and starboard mechanical actuators 55, as shown in FIG. 3C, which causes the mechanical decouplers 60 to disengage the first actuation means from the flow controls 41 and to operatively couple the second actuator 45 and mechanical decoupler 60 to the flow controls 41. The servo-valve 70 is arranged to operate in a "fail-safe" mode so that upon deactivation of the servo-valve, the second means is deactivated from the flow controls 41 and the first actuation means becomes coupled therewith.

With the switch element 66 engaging contact (C) the helm control signal (Dh) now passes to the port processing circuit shown in FIG. 3B where the signal passes through a conditioning circuit to make the helm signal (Dh) compatible voltage-wise with the ship stabilizer command signal (Ds). The helm command signal (Dh) and the stabilizer command signal (Ds) are combined in a summing amplifier 49, and the resulting rudder command signal (Drc) is split up for processing by both the port and starboard processing circuits.

The rudder command signal (Drc) is produced by the rate gain processing circuits A,B and C in FIG. 3B. The roll rate (a') of the ship is determined by a roll rate sensor 46 of the type manufactured by Humphrey, Inc. The roll rate signal (a') then passes through a low pass filter 128 which is utilized to filter out the high frequency signals, such as those above 10 Hz. The roll rate signal (a') then passes through a signal conditioning amplifier 129 that is provided with a means for determining the natural roll frequency of the vessel at the "unstab" contact and a means for determining how well the rudder performs in controlling the roll motion of the vessel. Thereafter, the roll rate signal (a') passes through a gain amplifier 130 that conditions the signal for further processing. The roll rate signal (a') is split at this point with the signal being fed to a multiplier device 48 and an absolute value circuit 131. The absolute value circuit 131, which rectifies the roll rate signal, constitutes the initial processing element of the rate gain circuit 47. Thereafter, the rectified roll rate signal (a') is fed to a smoothing circuit 132 that employs an integrator element 133 of the type made by Analog Devices (type 52J). The circuit is utilized to smooth out or average the peaks and valleys in the rectified signal, thereby in effect averaging the roll rate over a period of time. The signal is then fed to a minimum value circuit 134 to ensure that the voltage signal in the circuit will always be above a minimum value. The voltage signal from the absolute value circuit 134 is therafter fed to a divider circuit 135 such as manufactured by Analog Devices (model #AD434B). The divider circuit 135 generates the reciprocal of the incident voltage signal so that the minimum predetermined voltage value set by the minimum value circuit 134 produces a maximum output signal from the divider circuit 135. This maximum output voltage represents the maximum rate gain factor (K) produced by the rate gain circuit 47. The rate gain signal (K) from the divider circuit is passed through another smoothing or averaging circuit 136 to reduce the excursions of the signal from the actual mean value. The resultant rate gain signal (K) represents the reciprocal of the statistical time average of the roll rate modified by the maximum allowable rudder rate and the natural roll period of the vessel. The rate gain signal (K) produced by the rate gain circuit 47 and the roll rate signal (a') split off from the absolute value circuit 131 are combined in the multiplier 48 to produce a resultant rudder stabilizer command signal (Ds). The stabilizer command signal (Ds) then passes to the summing amplifier 49, as shown in FIG. 3B, for addition with the helm command signal (Dh). The signal (Drc), where (Drc=Dh+Ds), then passes to a limiting circuit 137, as shown in FIG. 3B, for limiting the maximum voltage (±) of the rudder command signal (Drc) to a predetermined value. In this particular circuit, the rudder command signal (Drc) has been limited to ±6 volts. The rudder command signal is thereafter split and respectively fed to the difference amplifiers 50 of the port and starboard processing circuits. The rudder position feedback signal (Drp), which is connected to the rudder machinery and indicated schematically in FIG. 3C, is combined with the rudder command signal (Drc) to produce the error signal (De). The signals then pass through a second limiting circuit 138 that utilizes the indicated transistors (type 2N3904, 2N3906) to set the voltage at ±0.2 volts or less. The resulting error signal (De) is combined in difference amplifier 51 with a swashplate angle feedback signal (Dpa) produced by a potentiometer 110 connected to mechanical actuator 55 which in turn is mechanically interlinked with swash plate flow controls 41. The resulting signal (Dsp) is fed through a power amplifier 139, which increases the voltage or gain of the signal, to solenoid operated fluid valves 90 connected to the mechanical actuators 55 for controlling the position of the swash plate flow controls 41.

Obviously many modifications and variations of this invention are possible in light of the above teachings. It is therefore to be understood that within the scope of the appended claims the invention may be practiced otherwise than as specifically described.

What is claimed is:

1. A ship stabilization system which utilizes the rudders to compensate for wave and wind induced roll motions, comprises:

a hydraulic control means connected to the rudders for controlling the position of the rudders;

flow control means connected to the hydraulic control means for controlling the flow of hydraulic fluid in the hydraulic control means to produce a predetermined rudder movement; and a roll reduction actuation means connected to the flow control means for translating helm steering command signals and roll reduction control signals into a control impulse for the flow control means, said roll reduction actuation means includes a roll rate sensor for determining the roll rate (a') of the vessel and a rate gain circuit for producing a roll rate gain factor (K) which is multiplied with the roll rate (a') to produce a resultant roll reduction control signal (Ds) equivalent to (Ka').

2. The ship stabilization system according to claim 1, wherein:

the rate gain circuit sequentially includes an absolute value circuit for rectifying a roll rate signal (a'), a smoothing circuit for reducing the excursions of the rectified signal about a means value, a minimum voltagd circuit for ensuring that the output signal from the smoothing circuit is above a predetermined minimum value, a divider circuit for producing the reciprocal of the output signal from the minimum value circuit, and a smoothing filter for reducing the excursions of the signal from the divider circuit about a means signal value.

3. The ship stabilization system according to claim 2, wherein:

the roll rate gain factor (K) represents the reciprocal of the time-average of the roll rate (a'), modified by the maximum allowable rudder rate and the natural roll period of the vessel.

4. The ship stabilization system according to claim 1, wherein:

the roll reduction control signal (Ds) and the helm steering command signal (Dh) are combined in a summing device to produce a rudder command signal (Drc).

5. In a roll reduction actuation means for a ship rudder stabilization system for controlling ship rudder to reduce wave and wind induced roll motions;

a means for generating a stabilizer command signal (Ds) for the ship rudders, said actuation means comprising a roll rate sensor for producing a ship roll rate signal (a') and a rate gain circuit for producing a roll rate gain factor (K), which is multiplied with the roll rate signal (a') to produce said stabilizer command signal (Ds).

6. The structure a set forth in claim 5, wherein:

the rate gain circuit sequentially includes an absolute value circuit for rectifying a roll rate signal (a'), a smoothing circuit for reducing the excursions of the rectified signal about a mean value, a minimum value circuit for ensuring that the output signal therefrom is above a predetermined minimum value, a divider circuit for producing the reciprocal of the output signal from the minimum value circuit, and a smoothing filter for reducing the excursions of the signal from the divider circuit about the value of the output signal from the smoothing filter.

* * * * *